US006075955A

United States Patent [19]

Cais et al.

[11] Patent Number: 6,075,955

[45] Date of Patent: Jun. 13, 2000

[54] NOISE REDUCING DEVICE FOR PHOTOSENSITIVE DRUM OF AN IMAGE FORMING APPARATUS

[75] Inventors: Rudolf E. Cais, Virginia Beach; William F. Niederstadt, Chesapeake; Dennis C. Working, Norfolk, all of Va.

[73] Assignee: Mitsubishi Chemical America, Inc., Chesapeake, Va.

[21] Appl. No.: 09/012,580

[22] Filed: Jan. 23, 1998

[51] Int. Cl.[7] ..... G03G 15/00

[52] U.S. Cl. ..... 399/91; 399/159

[58] Field of Search ..... 399/91, 116, 117, 399/159

[56] References Cited

U.S. PATENT DOCUMENTS

| | | | |
|---|---|---|---|
| 1,092,464 | 4/1914 | Watson et al. . | |
| 2,429,293 | 10/1947 | Peck et al. . | |
| 3,490,841 | 1/1970 | Cely, Jr. et al. . | |
| 4,003,334 | 1/1977 | Samuels et al. . | |
| 4,376,579 | 3/1983 | Wakao | 399/117 |
| 4,561,763 | 12/1985 | Basch | 399/116 |
| 4,575,221 | 3/1986 | Onoda et al. | 399/114 |
| 4,601,963 | 7/1986 | Takahashi et al. | 399/159 X |
| 5,052,090 | 10/1991 | Kitaura et al. | 399/159 X |
| 5,151,737 | 9/1992 | Johnson et al. | 399/117 |
| 5,164,779 | 11/1992 | Araya et al. | 399/176 |
| 5,177,854 | 1/1993 | Herbert, Jr. et al. . | |
| 5,195,228 | 3/1993 | Fukunaga et al. . | |
| 5,210,574 | 5/1993 | Kita | 399/117 |
| 5,272,506 | 12/1993 | Goto et al. | 399/176 |
| 5,305,177 | 4/1994 | Aoki et al. | 399/174 X |
| 5,357,231 | 10/1994 | Miwa et al. | 399/159 X |
| 5,379,693 | 1/1995 | Hoffmann et al. . | |
| 5,396,314 | 3/1995 | Umeda et al. | 399/31 |
| 5,412,455 | 5/1995 | Ono et al. | 399/176 |
| 5,422,706 | 6/1995 | Tsunemi et al. | 399/159 |
| 5,430,526 | 7/1995 | Ohkubo et al. | 399/159 |
| 5,457,522 | 10/1995 | Haneda et al. | 399/176 |
| 5,461,464 | 10/1995 | Swain | 399/159 |
| 5,463,450 | 10/1995 | Inoue et al. | 399/174 |
| 5,483,330 | 1/1996 | Ogiyama et al. | 399/318 |
| 5,485,248 | 1/1996 | Yano et al. . | |
| 5,488,459 | 1/1996 | Tsuda et al. | 399/167 |
| 5,552,865 | 9/1996 | Osawa et al. . | |
| 5,553,541 | 9/1996 | Vrotacoe et al. . | |
| 5,585,894 | 12/1996 | Araya et al. . | |

(List continued on next page.)

FOREIGN PATENT DOCUMENTS

| | | | |
|---|---|---|---|
| 63-60481 | 3/1988 | Japan . | |
| 63-153572 | 6/1988 | Japan . | |
| 63-155169 | 6/1988 | Japan . | |
| 1-282567 | 11/1989 | Japan . | |
| 5-35166 | 2/1993 | Japan | 399/130 |
| 5-35167 | 2/1993 | Japan | 399/159 |
| 5-188839 | 7/1993 | Japan | 399/159 |

OTHER PUBLICATIONS

Chatter Vibration of a Cleaner Blade in Electrophotography, by Kawamoto, in the Jan./Feb. 1996 issue of Journal of Imaging Science and Technology, pp. 8–13.

*Primary Examiner*—William J. Royer
*Attorney, Agent, or Firm*—Oblon, Spivak, McClelland, Maier & Neustadt, P.C.

[57] ABSTRACT

A device and method for reducing noise and/or vibration in an image forming apparatus. In a preferred form, an insert is disposed inside of a photosensitive drum, and the insert is a hollow tubular member having at least one slot extending through the tubular member so that the tubular member is resilient in a radial direction. The slot can be, for example, helical, so that the insert is a helical coil, with an outer diameter of the helical coil (in an uncompressed state) larger than an inner diameter of the photosensitive drum. The insert is radially compressed when it is inserted into the drum, so that the tendency of the insert to expand holds the insert in place within the drum. The insert reduces noise and vibration which can occur during operation of the photosensitive drum, and can also provide a supportive effect for the drum since the insert is urged in a radially outward direction against the inner surface of the drum.

24 Claims, 4 Drawing Sheets

U.S. PATENT DOCUMENTS 5,594,531 1/1997 Shishido et al. .
5,626,997 5/1997 Mashimo et al. .
5,631,727 5/1997 Ehara et al. .
5,640,649 6/1997 Kikuchi et al. .
5,652,647 7/1997 Yashiro et al. .
5,669,045 9/1997 Swain .
5,675,893 10/1997 Yamada et al. .
5,722,016 2/1998 Godlove et al. ..... 399/159
5,739,900 4/1998 Isobe .
5,771,425 6/1998 Yamada et al. ..... 399/111

NOISE REDUCING DEVICE FOR PHOTOSENSITIVE DRUM OF AN IMAGE FORMING APPARATUS

TECHNICAL FIELD

The invention relates to image forming apparatus, and particularly to photosensitive drums in which an insert is provided for reducing noise and/or vibration.

BACKGROUND OF THE INVENTION

Discussion of Background

Image forming apparatus, such as printers or photocopies, include a photosensitive member, typically in the form of a photosensitive drum. The performance of the photosensitive drum is of critical importance, since the image being produced (or reproduced) is formed and developed on the drum surface. The developed image is then transferred from the drum to, for example, a sheet of paper. Typically, the drum is formed of metal, such as aluminum, and the metal is anodized or coated to provide a thin dielectric layer. The drum is then coated with photogeneration and photoconduction layers over the dielectric layer.

In forming an image, the drum is rotated, and a given location on the outer surface of the drum is thereby rotated past a charging device, an exposure location, a developing location (at which toner is applied), a transfer location (at which the toner image is transferred from the drum to paper), and a cleaning location at which a cleaning blade removes excess toner from the drum so that the process can be repeated. During an image forming operation, as a result of the rotation of the photosensitive drum, and its interaction with the various other components of the image forming apparatus, noise and vibration can occur. This is particularly true since the photosensitive drum is a thin-walled metal drum, and thus has a characteristic harmonic sound spectrum which is easily driven by any mechanical resonance. For example, vibration (and associated noise) can occur from the rotation of the drum, and any imperfections of the drum, the gear flanges attached to the drum, and/or the drive which interacts with the gear flanges of the drum. Further, an alternating current (AC) electric field is applied to the charge roller, and the alternating current can also cause noise and/or vibration of the drum or between the drum and other components. In addition, as the drum rotates past the cleaning blade (which is in contact with the drum), noise is often generated, particularly if the drum surface is roughened by use. This interaction between the drum and cleaning blade is also known as chatter vibration or "stick-slip" vibration. (See, e.g., Chatter Vibration of a Cleaner Blade in Electrophotography, by Kawamoto, in the January/February 1996 issue of Journal of Imaging Science and Technology.) The noise and vibration associated with operation of a photoconductive drum not only presents an annoyance to workers using (or in the vicinity of) the image forming apparatus, but also, the noise/vibration can lead to image deterioration or damage to the apparatus. In particular, the vibration can result in poor performance or interaction between the photosensitive drum and one or more of the components with which the drum interacts, including the cleaning blade, the charge roller, the developer device, etc. Vibration may cause image blurring especially with the current trend to higher resolution devices (evolutions from 300 to 1200 dots per inch). For example, if the cleaning blade does not properly remove residual toner, undesirable resolution of character images can occur in subsequent images. Further, if the drum is not changed or developed properly, the resulting image can have white spaces where the image has not been properly formed, developed or transferred, or black spots where undesired toner has been transferred to the sheet of paper. Noise problems can also occur as a result of the generation of gases (ozone) which occurs during an image forming operation, however this noise is typically relatively small.

To eliminate noise and/or vibration, the physical characteristics of the drum can be modified, for example, by increasing the thickness of the drum. Thus, the drum can be designed so that its natural frequency differs from that of other components of the apparatus and/or that of the process cartridge (the unit within which the drum is disposes). As a result, the vibrations are eliminated or reduced, or the frequency of the noise which might occur can be shifted so that it is outside of the audible range. However, increasing the thickness of the drum can make the drum more expensive to manufacture, particularly if the tooling utilized to manufacture a drum must be replaced. In addition, thicker drums may have an undesirable increase in heat capacity and excessive weight causing higher inertia and drive torque. Moreover, when photosensitive drums are manufactured as replacement parts, they will often be inserted into process cartridge of another manufacturer. The process cartridge could be refurbished or a newly manufactured replacement process cartridge of a different manufacturer than that of the photosensitive drum, and the manufacturer/refurbisher of the process cartridge could change (or the design of a given manufacturer/refurbisher could change). Thus, it can be difficult to simply select a thickness of the drum which will be suitable for avoiding noise problems, since even if a thickness is selected for a certain process cartridge, that thicknes could be unsuitable for another process cartridge. As a result, noise problems can be particularly problematic with photosensitive drums manufactured as replacement parts.

A further difficulty which can arise with photosensitive drums is that the roundness or circularity of the drum can vary over time, which can also lead to image deterioration. The roundness or circularity of the drum can more rapidly deteriorate if the drum is vibrating and contacting other components disposed about the drum. This problem can also be reduced by providing a thicker drum, however as discussed above, increasing the thickness of the drum can increase the cost, from a materials standpoint and/or the requirement for new tooling.

An alternate solution which has been utilized in the past for solving noise and/or vibration problems has been to insert plugs within the photosensitive drum. U.S. Pat. No. 5,488,459 to Tsuda et al. discloses an example of such an approach. With this solution, a disk or cylindrical object is inserted into the drum, and the insert provides additional weighting to the drum to alter the mass/frequency characteristics of the drum. However, the use of plug-type inserts is undesirable for a number of reasons. First, the plug is often required to be positioned at a precise location within the drum, which can complicate the manufacturing process. Further, the plug must be secured in place, which can require the use of an adhesive, thus further complicating the manufacture/assembly process. An interference fit can also be provided between the drum and plug, however, an interference fit could result in deformation of the drum. Further, the plug and/or its associated adhesive can alter the performance characteristics of the drum. For example, as noted above, after a period of use, the circularity of the drum can deteriorate. The use of a plug can make the drum less uniform, since the plug will be located at a given position and will provide additional support, while portions of the drum spaced from the plug will not be supported. Further, the plug must be precisely manufactured. If it is too large, it could cause deformation of the drum, or be difficult to insert within the drum. If the plug is too small, it can be difficult to position the plug within the drum and secure the plug in place. Thus, the use of a plug or weight which is inserted inside of the drum has been less than optimal.

In view of the foregoing, a device and method are needed for reducing noise and/or vibration in image forming apparatus, particularly noise and/or vibration associated with operation of a photosensitive drum. Such a device and method are preferably suitable for use in both original equipment and for replacement parts.

SUMMARY OF THE INVENTION

It is an object of the present invention to provide a device and method for reducing noise and/or vibration in an image forming apparatus.

It is another object of the invention to provide a device and method for eliminating or reducing noise or vibration which can occur during operation of a photosensitive drum in original equipment of an image forming apparatus, or during operation of replaced or refurbished parts of an image forming apparatus.

It is a further object of the invention to provide a device and method which will provide for more reliable and consistent performance of a photosensitive drum in an image forming apparatus.

It is yet another object of the invention to provide an insert device for a photosensitive drum which can be easily installed inside of a photosensitive drum, without requiring the insert to be bonded within the drum.

The above and other objects and advantages are achieved in accordance with the present invention by providing a resilient insert which is inserted into a photosensitive drum, which in its expanded (or uncompressed) state, has an outer dimension which is larger than the inner diameter of the photosensitive drum. As a result, when the insert is disposed inside of the photosensitive drum, it is urged against the inner surface of the photosensitive drum, thereby holding the insert in place without requiring the use of an adhesive. Further, the bias of the insert against the inner surface of the photosensitive drum can provide a supportive effect to the photosensitive drum, thereby rendering the drum more durable and less susceptible to deformation or deviation of the photosensitive drum from its circularity or roundness about the circumference of the drum.

In a presently preferred form of the invention, the insert is in the form of a helical or spiral coil, preferably formed of plastic. The outer diameter of the helical coil is larger than the inner diameter of the photosensitive drum. However, the helical coil is readily compressed radially so that it can be inserted into the photosensitive drum. Once inserted, the helical coil applies a force against the inner surface of a drum, thereby holding the helical coil in place. The helical coil can be formed by making a helical cut in a plastic tube, with the plastic tube having, for example, an outer diameter which is at least the same as the outer diameter of the photosensitive drum. Once the tube is cut helically, it can then be cut into sections of an appropriate length, or the tubing can be cut to appropriate length prior to the helical cutting operation, Preferably, the length of the coil is such that is extends over the majority of the length of the drum, and more preferably along substantially the entire length of the drum between the flanges of the drum.

The arrangement of the present invention is advantageous in a number of respects. First, the helical coil can vary the mass/frequency characteristics of the drum, to thereby ensure that the resonance frequency of the drum is outside of the audible range, or does not match the resonance frequency of other components of the apparatus. Further, since the helical coil is relatively light, it can be distributed or extend along a majority of the length of the drum, thereby preventing disadvantages associated with prior plug-type inserts in which the plug or weight is concentrated at specified location within the drum. The arrangement is further desirable over plug-type inserts in that the tendency of the helical coil to expand holds the helical coil in place inside of the drum, and therefore, an adhesive is not required for holding the insert inside of the drum. The arrangement is also advantageous in that if a modification to the insert is needed (e.g., in the thickness, length, weight etc.), such a modification can be made to the insert (e.g., by selecting a thicker plastic tubing to form the helical coil) more readily than making modifications to the photosensitive drum itself, and therefore, new tooling costs associated with drum manufacturing equipment can be avoided. The arrangement is further advantageous in that the helical coil is hollow (having a thickness on the order of, for example, one to two times the thickness of the photosensitive drum), and therefore, heat is more readily dissipated from the drum, and localized temperature discontinuities (which can occur with, for example, a plug-type insert which fills the area between the drum shaft and the inner surface of the drum) are avoided. Although a helical coil insert is presently preferred, it is to be understood that other configurations are also possible. For example, rather than providing a continuous helical slot in a tubular member to form a helical coil, a series of discrete longitudinal and/or diagonal slots can be provided in a tubular member so that the tubular insert is radially resilient.

BRIEF DESCRIPTION OF THE DRAWINGS

Other objects and advantages of the present invention will become apparent as the same becomes better understood with reference to the following detailed description, particularly when considered in conjunction with the drawings in which.

DETAILED DESCRIPTION OF THE PREFERRED EMBODIMENTS

Figure 1:
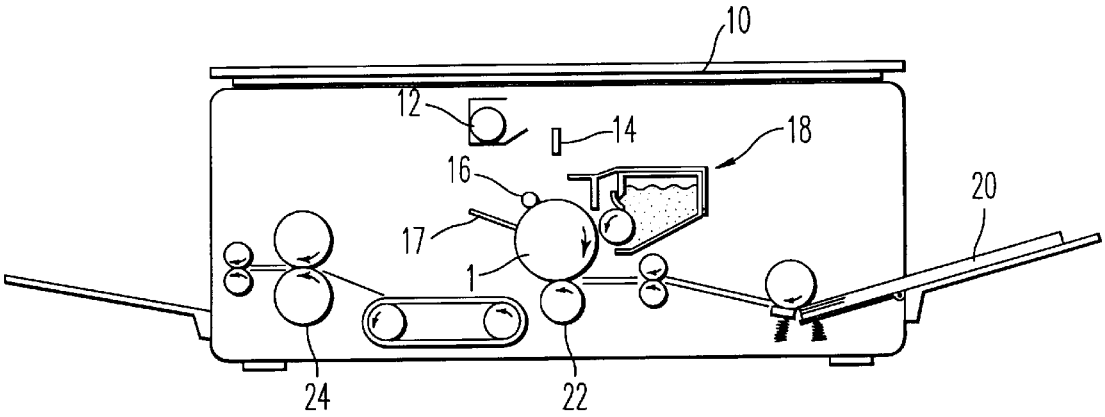
FIG. 1 schematically represents a photocopier to which the present invention is applicable.

FIG. 1 schematically represents an image forming apparatus in the form of a photocopies to which the present invention is applicable. In such an arrangement, an original document is placed upon the photocopier glass 10, and is illuminated by a lamp 12. The resulting light is then projected onto a photosensitive drum 1 by way of an optical system 14, and the drum has been previously charged utilizing a charge roll 16. As a result, an electrostatic latent image is formed on the drum 1, and a developing unit 18 then supplies toner to the drum 1 to develop the electrostatic latent image. Paper is fed from a source 20 by various rollers to a location between the drum 1 and a backup roller 22, so that the toner image on the drum is transferred to the paper. The paper is then fed to a fixing device 24 which, typically utilizing heat, fixes the toner image to the paper and the paper is then conveyed out of the apparatus. A cleaning blade 17 is provided downstream from the backup roller 22 (i.e., downstream with respect to the direction of rotation of the drum 1), so that any residual toner remaining on the drum after the image is transferred to the sheet is removed by the cleaning blade 17. The toner removed by the blade then falls into a container (not shown) provided for collecting residual toner. The drum is then provided with an initial charge by the charge roller 16, and the process is repeated for the next image.

Figure 2:
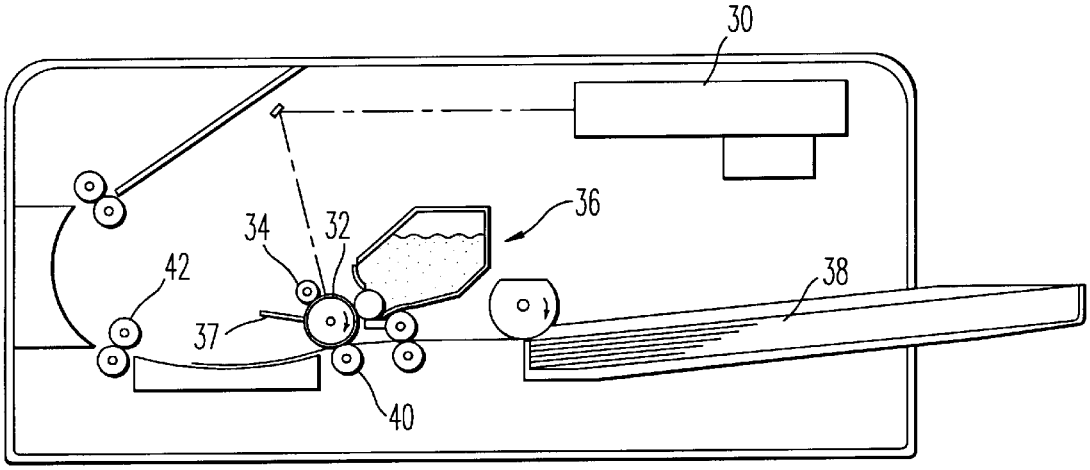
FIG. 2 schematically represents a printer to which the present invention is applicable.

FIG. 2 schematically represents a printer device to which the present invention is also applicable. As shown in FIG. 2, the contrast with the photocopier device, the printer provides an image by way of a control unit which provides a video signal, for example, by a laser scanning unit 30. The laser scanning unit 30 thus provides a latent image onto the photosensitive drum 32, which has been uniformly charged with a charger roller 34. The image is developed by a developing device 36, and is transferred to paper, which is fed from a source 38, as the paper passes between the photosensitive drum 32 and a backup roller 40. The paper then travels past a fixing device 42 and out of the printer by various conveying rollers and guides. Residual toner can be removed by a cleaning blade 37.

As should be apparent from the foregoing, the photosensitive drum is critical to the image forming process, and for each cycle of operation, the photosensitive drum is required to cooperate and interact with a number of components, including the charge roller, the optical image forming system, the developing device, the backup roller and the cleaning blade. As the drum rotates, it can also vibrate as a result of the drive utilized in rotating the drum, imperfections in the drum and/or the gear flanges of the drum, etc. Further, where an AC current is applied to the charge roller 16, 34, the alternating charge can also have a tendency to cause vibration and/or noise during operation of the drum, as can the frictional contact of the drum with the various components including the cleaning blade, charge roller and developing device. The operation of a charge roller has also been found to generate ozone gas by localized electric discharge (known as the Paschen discharge effect), and this discharge is also believed to be a potential cause for noise and/or vibration of the drum.

The generation of noise and/or vibration is often accompanied by a deterioration in the image quality, since the drum is not smoothly and consistently interacting with the other components of the image forming apparatus. As a result, toner may appear in areas in which it is not desired (undesirable black spots), and/or toner will not appear in areas required for forming the image (undesirable white spots). Less than optimal images can also occur over a period of use as the circularity of the drum diminishes. In particular, after the drum has operated for a number of cycles, certain locations of the drum can become deformed so that the cylindrical shape of the drum becomes more imperfect. This loss of circularity also contributes to degradation of the image quality, and the loss of circularity can occur more rapidly if the drum vibrates, since the drum can be exposed to more concentrated forces or forces of a larger magnitude than would be the case if the drum were smoothly rotated. Of course, the generation of undesirable noise and vibration can also be an annoyance to the operator of the apparatus, or those in the vicinity of the apparatus.

In order to avoid or reduce noise, some equipment manufacturers have designed the drum so that the natural resonance frequency of the drum does not match that of any of the surrounding components, and also so that the natural resonance frequency of the drum is not in the audible range. As a result, if vibration should occur, it is less destructive, since the frequency does not match that of the surrounding components. In addition, the noise is not audible (or is less likely to be audible) to the operator or those in the vicinity of operation of the apparatus. However, if a noise problem is found to occur in existing equipment, it can be quite costly to redesign tooling necessary to change the dimensions (e.g., the tube thickness) of the drum. Further, even if the tube thickness is modified, such a solution might not be satisfactory in addressing noise and/or vibration in all replacement parts situations, since the process cartridge (within which the drum is disposed) can vary with different manufacturers and models, and the manufacturer or refurbisher of process cartridges (or other components) is not always the same as that of the photosensitive.

Another approach is minimizing noise and/or vibration in photosensitive drums has been to insert a plug or weight at a predetermined location within the drum. However, the use of a plug-type insert can be undesirable in that the plug is typically required to be inserted at a particular axial location within the drum, and if improperly placed, the plug will not perform properly, and could even worsen the noise or vibration problems. In addition, the plug must be either adhered in place, or an interference fit can be utilized so that the plug is secured in place once inserted. Fixing the plug with an adhesive can be cumbersome, and could result in the adhesive being inadvertently disposed at locations other than desired, or the plug could shift if the drum is transported prior to curing of the adhesive. If an interference fit is utilized, the drum could be deformed upon insertion. Further, since the drum is supported at the location of the plug, but not in other areas, the performance and response of the drum at the location of the plug might not be consistent with that of locations of the drum other than that where the plug is disposed.

Figure 3A:
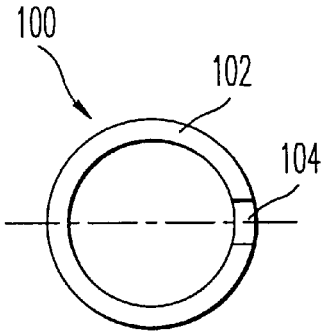
FIGS. 3A and 3B are end and side views of an insert for a photoconductive drum of the present invention.
Figure 3B:
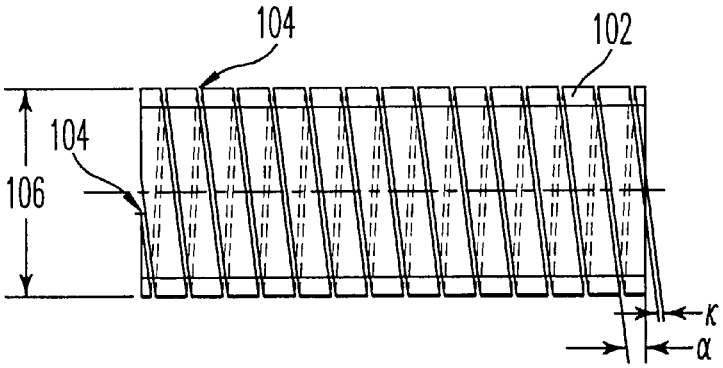
Figure 7:
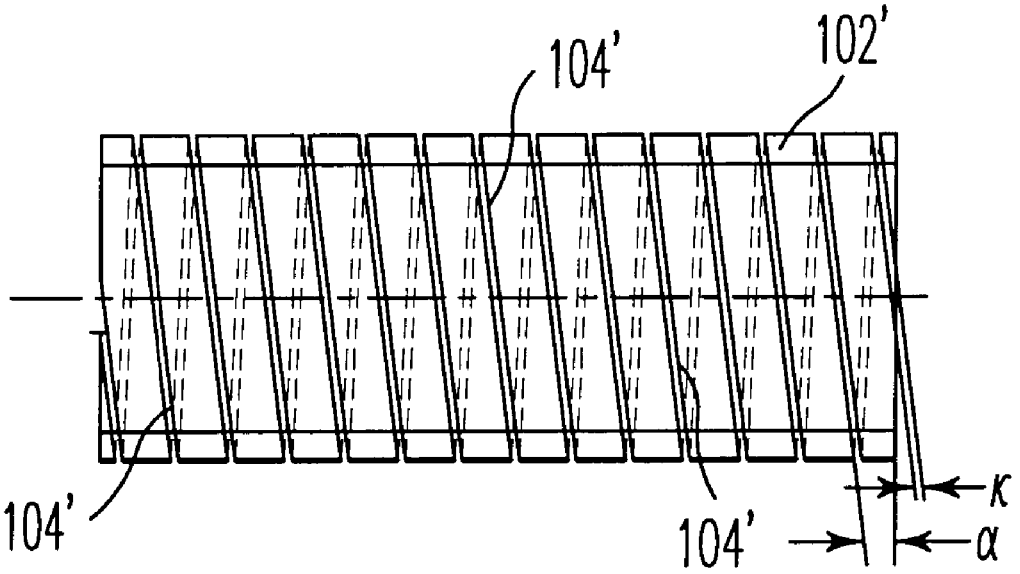
FIG. 7 depicts an embodiment of the invention in which plural non-continuous helical slots are provided.

FIGS. 3A and 3B depict an insert in accordance with the present invention. As shown in FIG. 3A, in a presently preferred form, the insert 100 is formed as a tubular member 102, in which a slot 104 has been cut through the wall of the tube 102. As shown in FIG. 3B, the slot 104 in a presently preferred form is helical, so that the tube 102 forms a helical coil. The insert can be formed of a plastic or polymeric material, and the particular plastic or polymeric material can be chosen according to desired mechanical and electrical properties including, but not limited to, elasticity, resiliency, density, glass transition temperature, thermal capacity and cost. By way of example, in forming the insert 100, a continuous length of plastic (e.g., acrylonitrile butadiene styrene) tube can be provided, and the helical slot 104 can be cut through the tube 102 utilizing, e.g., a lathe and cutting blade. The tube can then be cut to the lengths desired for insertion into the photosensitive drum. It is to be understood that other slot configurations could also be utilized, and the slot (or slots) of the tube could also be formed by means other than cutting. For example, rather than a continuous helical slot, plural longitudinal and/or diagonal (or helical sections) slots could be utilized to render the insert more radially resilient. By way of example, FIG. 7 depicts an arrangement in which non-continuous helical slots 104' are provided in the tube 102'. In addition, the slot(s) could be provided by molding the insert with one or more slots in lieu of cutting.

By providing the slot 104 (or multiple slots) in the tube 102, the tube becomes more resilient, and more readily deformable uniformly and radially. As a result, the helical coil or slotted tube can be deformed radially for insertion into a photosensitive drum. Further, once the tube or helical coil 102 is deformed radially inwardly (or compressed radially inwardly), it will be biased to expand radially outwardly. By sizing the outer diameter 106 of the tube to be larger than that of the inner diameter of the photosensitive drum, the insert is compressed when inserted into the drum. After insertion into the drum, the resiliency or tendency of the helical coil to expand causes the helical coil to be biased against the inner surface of the photosensitive drum, and this biasing force holds the helical coil in place against the inner surface of the photosensitive drum. By way of example, and not to be construed as limiting, if the outer diameter 106 of the insert is the same as the outer diameter of the photosensitive drum, the insert has been found to deform sufficiently so that it is readily inserted into the inner diameter of the drum, and held in place inside of the drum by the tendency of the insert to expand to its uncompressed state. The slot can be formed to extend at a helix angle $\alpha$ (FIG. 3B). The helix angle can be varied to adjust the radial spring constant of the insert and/or to provide desirable cutting and insertion characteristics of the insert. By way of example, a helix angle $\alpha$ of 5–10° is presently preferred. An angle of 7° has been found to be acceptable, and a width of the cut or kerf k of one-eighth of an inch has also been found suitable, and a thickness of the plastic tube of approximately 2 mm has also been found suitable in providing satisfactory forming and handling characteristics of the insert, and also in providing satisfactory reduction of noise and vibration. It is to be understood that the dimensions and angles can vary. As discussed earlier, other slotting characteristics or shapes may also be possible in accordance with the present invention, as long as the slots assist in rendering the tube resilient, preferably resilient in a radial direction. Plastic materials are presently preferred from a noise reduction standpoint, although other materials may also be utilized. However, it is presently preferred that the material be non-metallic to avoid the generation of any undesirable fields as the insert is rotated with the photosensitive drum during operation of the image forming apparatus. The expansive force of the insert will vary with the material's modulus, slot configuration (e.g., helix angle) diameter or size of the insert, and wall thickness.

Figure 4:
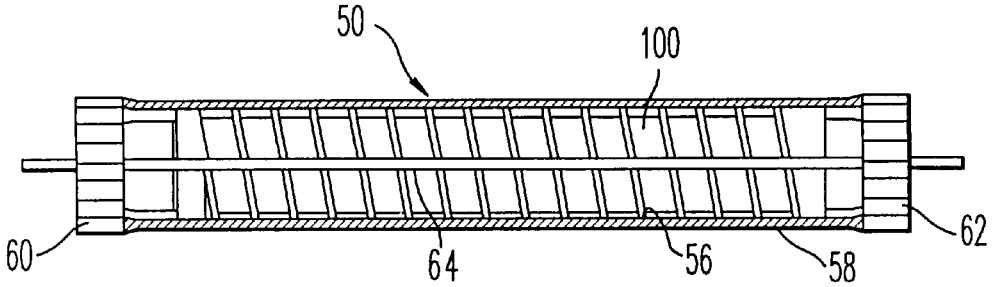
FIG. 4 is a partially cross-sectioned view of a photosensitive drum having an insert disposed therein in accordance with the present invention.

Referring to FIG. 4 a photosensitive drum is shown in partial cross-section, with an insert disposed therein in accordance with the present invention (as shown in FIG. 4, the insert is also cross-sectioned). As shown in FIG. 4, the photosensitive drum 50 includes an outer surface 58, and an inner surface 56. Flanges 60, 62 are inserted into each end of the drum, and a shaft 64 extends through apertures of the flanges 60, 62, to rotatably support the drum 50. As shown in FIG. 4, the flanges 60, 62 can also have gear surfaces formed thereon. Although each of the flanges 60, 62 has a gear surface formed thereon, it is to be understood that configurations of photosensitive drums and flanges vary. For example, with the arrangement shown in FIG. 4, one of the gears can be utilized to receive a driving force to rotate the photosensitive drum, while the other gear can be utilized for imparting a driving force to other components of the apparatus, e.g., rollers utilized for feeding paper. However, it is to be understood that the particular flange configurations represented in FIG. 4 are not to be construed as limiting. In addition, although the drum shown in FIG. 4 includes a shaft, often the photosensitive drum is mounted without a shaft.

Figure 5:
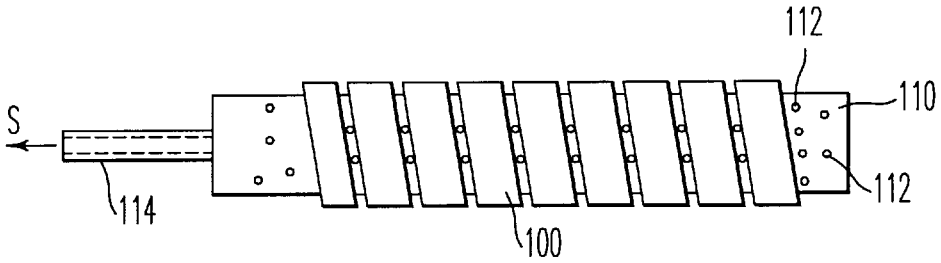
FIG. 5 depicts an insert of the present invention wrapped around a mandrel for insertion into a photosensitive drum.

In assembling the arrangement of FIG. 4, the helical or spiral insert is inserted into the drum 50 before the flanges 60, 62 are attached. Insertion of the insert 100 can be accomplished manually, for example, by feeding the insert into the drum while rotating or twisting the insert, to screw-feed the insert into the drum. This rotating motion assists the insert in deforming or yielding as it is being fed into the drum. The direction in which the insert is twisted during insertion depends on the direction of the coil. For example, if a coil as shown in FIGS. 3B and 4 is inserted from the right side of the drum of FIG. 4, it would be rotated so that the lower portion of the coil of FIG. 3B is turning into the page and the upper portion is turning out of the page. If rotated in the reverse direction, the tip of the coil (the leftmost portion of FIG. 3B) could become caught and the coil would have a tendency to unwind and thus resist insertion into the drum. A similar rotational insertion can be utilized in an automated process, and the direction of rotation during insertion would be the same as that of a manual insertion procedure. Of course, the direction of the spiral can be reversed where the automated or manual insertion is more convenient utilizing rotation in an opposite direction. In general, it is preferred to provide an insertion direction (i.e., the twisting direction) which matches the rotation of the drum.

Where an automatic insertion is desired, a clamp device can be utilized for clamping at least one end of the coil, utilizing a mandrel, and the mandrel can then be rotated as it feeds the coil into the drum. Alternatively, as shown in FIG. 5, a mandrel 110 can be provided which has a plurality of apertures 112 on its outer surface. The holes provide suction apertures, for example, by drawing a vacuum upon the mandrel through an arm or handle 114 of the mandrel as represented by arrow S. This suction can retract the coil (or other insert configuration) sufficiently to allow for insertion into the end of a drum. Once disposed inside of the drum, the vacuum can be released, and the coil will then expand so that the outer surface of the helical coil is held in contact with the inner surface 56 of the drum 50. Thus, the insert is held in place, without requiring adhesives or an interference fit as has been required with plug-type inserts in the past. Moreover, since the insert 100 is hollow, with grooves formed by the helical slot (i.e., when the insert is installed within the drum, the slots form grooves inside of the drum), heat is more readily dissipated inside of the drum. By contrast, plug-type inserts can retain heat, and can result in localized high temperature regions. Moreover, since the insert is disposed over a majority of the length of the drum, and since the insert urges against the inner surface 56 of the drum in a radially outward direction, the insert provides a supportive effect to the drum over a majority of the length of the drum. Thus, the drum is less susceptible to becoming deformed. In other words, the circularity of the outer surface of the drum is better maintained.

Figure 6:
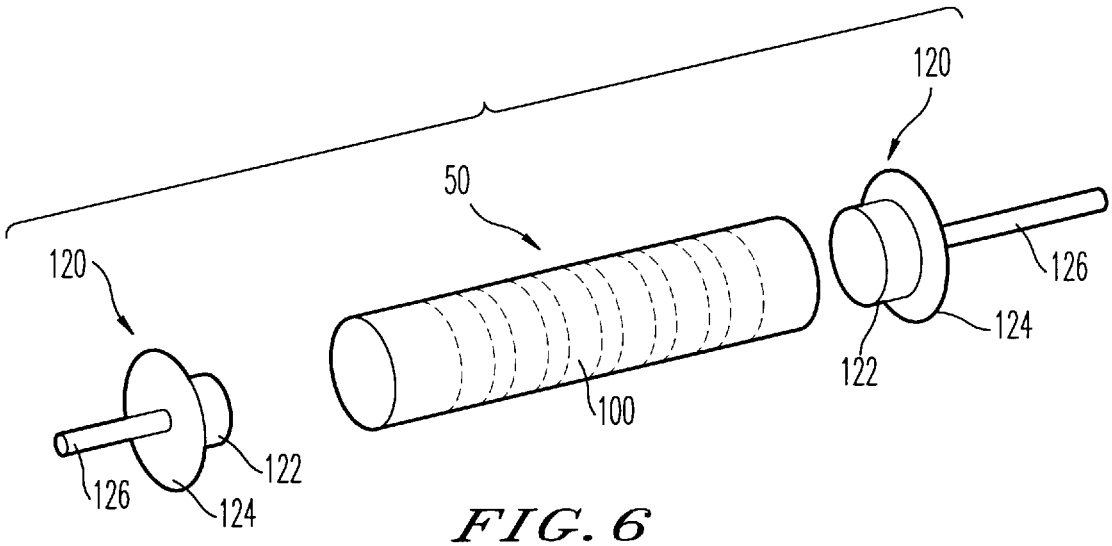
FIG. 6 depicts an insert disposed in a photosensitive drum, together with tools which can be utilized for ensuring that the insert is spaced from each end of the photosensitive drum.

After the insert is disposed inside of the drum, whether inserted manually or automatically, tools 120 can be utilized to ensure that the insert is sufficiently spaced from the ends of the drum as shown in FIG. 6. The tools 120 can include a disk or plug member 122 which has an outer diameter smaller than the inner diameter of the drum, but larger than the inner diameter of the insert (i.e., the inner diameter of the insert when it is in its compressed state disposed inside of the drum). The tools 120 can further include a collar or stop member 124 which halts insertion of the plug 122 after it has entered the drum a sufficient amount. Thus, when the tool 120 is inserted into the end of the drum, it pushes the end of the insert 100 away from the end of the drum, and insertion of the tool 120 is halted when the collar 124 touches the end surface of the drum. The tools 120 can be inserted manually or automatically utilizing handles 126. The collar 124 can be omitted in a manual insertion process if the worker is properly instructed as to the amount of the insertion of the tool 120 (e.g., by utilizing indicia on the handle 126, or by inserting the tool 120 only until the plug 122 is fully disposed in the end of the drum), and the collar 124 can also be omitted in an automatic operation where the stroke of the device which inserts the tool 120 is fixed. Either a pair of tools 120 can be utilized, or a single tool 120 can be utilized which is inserted into one end followed by insertion into the other end. The use of such a spacing tool 120 is believed to be desirable in properly positioning the insert 100 inside of the drum, and in ensuring that the insert will not interfere with the flanges 60, 62. It is to be understood, however, that the use of the tools 120 may also be eliminated, for example, if the insert 100 is properly positioned when it is initially inserted into the drum utilizing, for example, a mandrel as shown in FIG. 5.

After the insert is disposed within the drum 50, the gear flanges 60, 62 are then inserted into each end of the drum. The drum can then be rotatably mounted upon a shaft 64 (if a shaft is utilized) and disposed within a process cartridge to be utilized in a photocopier or printer.

In a presently preferred form of the invention, the helical or spiral insert can be manufactured utilizing extruded plastic pipe commercially available. A spiral cut is then made of the desired pitch angle (e.g., 7°) as the pipe is continuously fed in a turret lathe to form the helical coils. The helical coils can then be cut to the desired length, preferably so that the helical coil extends along a majority of the length of the photosensitive drum. It is to be understood however that alternate manufacturing methods are also possible. For example, a metal wire or strip can be wound about a mandrel to form a helical coil (with the slots provided by spaces between adjacent windings of the coils), and the helical coil can then be thermally treated or quenched to form a continuous helical coil about the mandrel. The helical coil thus formed can then be inserted in the same manner as with the cut plastic helical coils discussed earlier. As with the cut plastic helical coils, the metal coil will preferably have an outer diameter in its uncompressed state which is larger than the inner diameter of the photosensitive drum. Plastic helical coils can also be formed by injection molding, for example, with a hot melt screw injection into a chilled dye having the desired shape. Alternately, the plastic material could be wound about a mandrel when it is above its glass transition temperature, and then quenched so that the plastic material is formed into the desired shape.

The present invention has proven to be a solution to audible noise problems in image forming apparatus. In particular, helical coils were formed utilizing cut plastic tubing, in which the thickness of the cut plastic tubing was 2 mm, and the outer diameter of the tubing (uncompressed) was the same as the outer diameter of the OPC drum. The helical coil tubing was formed utilizing a cutting angle or helix angle $\alpha$ of 7°, and a slot thickness or kerf k (i.e., the spacing between adjacent coils formed by the cutting operation) of one-eighth of an inch. When the drum having an insert was placed in the printers in which audible noise was previously observed, the audible noise was eliminated.

A drum having an insert as described above was also compared with a drum without an insert by subjecting each to a sudden impact (a 0.1 second ping). Linear audio images were picked up with a microphone, amplified and digitized, and resonance differences were captured by imaging the resulting vibration using a soundcard attached to a high speed microprocessor to provide digitized amplitude vs. frequency signals. The results demonstrated the insert to be very effective in reducing noise and vibration.

Obviously, numerous modifications and variations of the present invention are possible in light of the above teachings. It is therefore to be understood that, within the scope of the appended claims, the invention may be practiced otherwise and as specifically described herein.

What is claimed as new and desired to be secured by Letters Patent of the United States:

1. A photosensitive drum for an image forming apparatus comprising:

(a) a tubular photosensitive having:

(i) an outer photosensitive surface; and (ii) an inner surface;

(b) a noise prevention device comprising a hollow resilient member disposed inside of said tubular photosensitive member and in contact with said inner surface of said tubular photosensitive member, said hollow resilient member comprises a helical coil having a helix angle of 5–10°.

2. A photosensitive drum as recited in claim 1, wherein said hollow resilient member has an outer diameter when said hollow resilient member is not radially compressed, and wherein said tubular photosensitive member has an inner diameter, and further wherein said outer diameter of said hollow resilient member is larger than said inner diameter of said tubular photosensitive member such that when said hollow resilient member is disposed inside of said tubular photosensitive member said hollow resilient member is radially compressed.

3. A photosensitive drum as recited in claim 2, wherein said hollow resilient member comprises a non-magnetic tubular member having a helical slot formed therein to form said helical coil.

4. A photosensitive drum as recited in claim 1, wherein said hollow resilient member comprises a non-magnetic tubular member having a helical slot formed therein to form said helical coil.

5. A photosensitive drum as recited in claim 1, wherein said noise prevention device extends along a majority of the length of said tubular photosensitive member.

6. A photosensitive drum as recited in claim 1, wherein said noise prevention device comprises a tubular member having at least one slot extending through an outer surface of said tubular member.

7. A method for reducing at least one of noise and vibration in an image forming apparatus comprising:

providing a resilient member which, in an uncompressed state, has an outer dimension larger than an inner diameter of a photosensitive member wherein the resilient member includes a helical slot;

placing said resilient member in said photosensitive member such that said outer dimension of said resilient member is compressed and held against an inner surface of the photosensitive member; and twisting the resilient member, during said step of placing, in a direction such that the resilient member tends to compress during twisting.

8. A method as recited in claim 7, wherein the step of providing said resilient member includes:

providing a tubular member, and wherein said outer dimension is an outer diameter of said tubular member; and providing at least one slot in said tubular member such that said tubular member is radially compressible.

9. A method as recited in claim 8, wherein the step of providing at least one slot in said tubular member includes making at least one helical cut in said tubular member so that said tubular member forms a helical coil.

10. A method as recited in claim 9, wherein said helical coil is formed of a non-magnetic material.

11. A method as recited in claim 7, wherein the step of providing a resilient member includes providing a resilient tubular member which extends along the majority of the length of the photosensitive member.

12. A method as recited in claim 7, wherein said resilient member is a helical coil, and wherein said outer dimension is an outer diameter of said helical coil.

13. A method as recited in claim 12, wherein said outer diameter of said helical coil is substantially equal to an outer diameter of said photosensitive member.

14. A method as recited in claim 7, wherein the step of providing a resilient member includes providing a helical resilient member formed by one of:

(a) winding a non-magnetic material into a helical shape;

(b) cutting a helix in a non-magnetic tube to form a helical coil; and (c) molding a non-magnetic material to form a helical coil.

15. An image forming apparatus comprising:

(a) a photosensitive drum having an inner surface and an outer surface; and (b) an insert disposed inside of said photosensitive drum, said insert including an outer surface and at least one helical slot extending through said outer surface such that at least a portion of said insert is a helical coil having a helix angle of 5–10°.

16. An image forming apparatus as recited in claim 15, wherein said helical coil insert has an outer surface in contact with said inner surface of said photosensitive drum, and wherein said helical coil insert is resilient and exerts a force in a radially outward direction against said inner surface of said photosensitive drum.

17. An image forming apparatus as recited in claim 16, wherein said force in said radially outward direction holds said helical coil insert in place within said photosensitive drum such that an adhesive is not required to hold said helical coil insert in place within said photosensitive drum.

18. An image forming apparatus as recited in claim 15, wherein said insert extends along a majority of the length of said photosensitive drum.

19. A photosensitive drum for an image forming apparatus comprising:

(a) a tubular photosensitive having:

(i) an outer photosensitive surface; and (ii) an inner surface;

(b) a noise prevention device comprising a hollow resilient member disposed inside of said tubular photosensitive member and in contact with said inner surface of said tubular photosensitive member, said hollow resilient member comprises a plurality of non-continuous helical slots.

20. A photosensitive drum as recited in claim 19, wherein said plurality of helical slots includes a helix angle of 5–10°.

21. A photosensitive drum as recited in claim 20, wherein said plurality of helical slots includes a kerf width of one-eight of an inch.

22. An image forming apparatus comprising:

(a) a photosensitive drum having an inner surface and an outer surface; and (b) an insert disposed inside of said photosensitive drum, said insert including an outer surface and a plurality of non-continuous helical slots.

23. An image forming apparatus as recited in claim 22, wherein said plurality of non-continuous helical slots have a helix angle of 5–10°.

24. An image forming apparatus as recited in claim 23, wherein said plurality of non-continuous helical slots include a kerf width of one-eight of an inch.

* * * * *